US006357349B1

(12) United States Patent
Tomberlin et al.

(10) Patent No.: US 6,357,349 B1
(45) Date of Patent: Mar. 19, 2002

(54) WEB TENSIONING AND ALIGNING MODULE

(75) Inventors: Kevin W. Tomberlin, North Andover; John M. Fiske, Wakefield; Stephen E. Silva, Waltham; Brian A. Biggar, North Chelmsford, all of MA (US)

(73) Assignee: Roll Systems, Inc., Burlington, MA (US)

( * ) Notice: Subject to any disclaimer, the term of this patent is extended or adjusted under 35 U.S.C. 154(b) by 0 days.

(21) Appl. No.: 09/609,625

(22) Filed: Jul. 5, 2000

(51) Int. Cl.[7] ..... B41F 5/04

(52) U.S. Cl. ..... 101/219; 101/228; 101/DIG. 42; 226/195; 242/419

(58) Field of Search ..... 101/219, 228, 101/231, 232, DIG. 42; 226/3, 11, 45, 59, 195, 196, 199; 242/157 R, 413, 419, 615, 615.3, 615.4

(56) References Cited

U.S. PATENT DOCUMENTS 3,831,831 A * 8/1974 Flippen, Jr. et al. ..... 226/198
4,291,825 A * 9/1981 Glanz ..... 226/18
4,360,356 A * 11/1982 Hall ..... 493/459
4,893,763 A * 1/1990 Wales et al. ..... 242/58.6
5,647,276 A * 7/1997 Tilton, Sr. ..... 101/219
5,881,968 A * 3/1999 Hsu ..... 242/615.3

* cited by examiner

*Primary Examiner*—Ren Yan
(74) *Attorney, Agent, or Firm*—Cesari and McKenna, LLP; William A. Loginov

(57) ABSTRACT

A device for feeding web material to a printer that is adapted to accept web from an external roll, adequately align the web with the printer and properly tension the web as it passes through the printer. The infeed device includes a pair of parallel guide rods spaced sufficiently apart to allow passage of the web there between. A pair of edge guides, attached to the parallel guide rods define the web path there through. A spring-loaded pressure pad acts in combination with a smooth metal shoe to tension the web. Further tension is applied to the web as it passes a curved smooth metal surface, just prior to entering the printer. The infeed device allows a wide variety of web materials and web thicknesses to be tensioned and fed into the printer.

23 Claims, 6 Drawing Sheets

WEB TENSIONING AND ALIGNING MODULE

BACKGROUND OF THE INVENTION

1. Field of the Invention

This invention relates to an apparatus for feeding a large external roll of web material into a printer and aligning it therewith. More particularly, this invention relates to a web infeed device that provides proper tension on the web as it is received from an external roll and fed into a printer or other similar web-handling device.

2. Background Information

Some web-handling devices require that the web be properly aligned and under sufficient tension as it passes through the device. For example, certain single-pass duplex printers require a steady web tension, as the web passes through the printer, to maintain registration of a multiplicity of print drums. An example of these types of printers is the full process color printer family developed and manufactured under the trademark Xeikon, such as the printer shown and described in U.S. Pat. No. 4,499,093, which is expressly incorporated herein by reference. The present invention is specifically adapted for this line of printers, however, it is capable of accommodating other web-handling devices that require accurate alignment and tensioned web.

Single-pass multiple station printers, such as the printer shown and described in U.S. Pat. No. 4 499,093, include a plurality of toner image-printing electrostatographic stations. Each station has a drum onto the surface of which a toner image can be formed. An exposure station forms an electrostatic toner image line-wise on each drum surface. A corona device transfers the toner image onto the web, which is conveyed in succession past the stations in synchronism with the rotation of the drum surface. A register control device is provided for controlling the operation of each of the stations in timed relationship thereby to obtain correct registering of the distinct toner images on the web. The register control device includes an encoder driven by the displacement of the web to produce pulses indicative of web displacement, and delay system arranged to initiate the operation of subsequent stations after a predetermined web displacement, as measured by the encoder, has occurred. These types of printers enable accurate registration of transferred images, irrespective of the speed of the paper web through the printer, provided proper tension is maintained in the web throughout the printer.

These printers were designed to accommodate small internal rolls of web material (up to 18" diameter), using an internal roll stand. To achieve proper tension in the web material, when using an internal roll of web material, a weighted friction pad drags on the surface of the roll as web is fed into the printer. In order to accommodate larger diameter rolls of web material, external roll support and feed apparatuses, such as those described in U.S. Pat. No. 4,893,763 and in several continuation patents and applications, owned by Applicant, which patent is expressly incorporated herein by reference, are required. The rolls fed by this patent are several hundred pounds in weight and have a diameter of three to four feet when full.

One of the significant drawbacks with the use of external roll feeding machines is that it can be difficult to align the web material with the printer intake port. To achieve proper alignment between the external roll apparatus and the printer, an infeed module is used. These infeed modules are placed between the external roll apparatus and the printer and operate to align and tension the web as it comes off the roll and is fed into the printer. Current infeed models work for a limited range of web materials, as long as operators are careful to align the web path between the roll unwind device and the infeed module of the printer.

Prior infeed devices designed for this particular set of printers are portable, yet limited to a relatively narrow range of web materials that they can accommodate, typically 130 to 180 grams per square meter (gsm) papers, while the printer itself can handle papers from 60 to 250 gsm. One such device incorporates a curved-metal shoe and a spring-loaded brush to provide some drag tension on the web. Another limitation with this device, although they employ "ears" as web edge guides, they still require very accurate alignment of the web with the printer infeed section (the "PRS"). These devices typically are unable to provide sufficient and controllable tension and are difficult to thread up.

Accordingly, it is an object of the present invention to provide an improved portable infeed module, one that in particular has a very wide tolerance for web misalignment coming into the infeed, is simple in design and supports a fill range of paper weights (at least 60 to 350 gsm). This module should enable feeding of continuous web from a large, externally mounted roll on a driven roll stand. It is another object of the present invention that the improved infeed module is easy to thread up and that it does not require any modification to the existing printer paper supply.

SUMMARY OF THE INVENTION

To accomplish the foregoing and other objects, features and advantages of the invention there is provided an apparatus for feeding a large external roll of web material into a printer and aligning it therewith. In addition, the disclosed apparatus provides needed tension on the web as the web is drawn into and through the printer.

The apparatus of the present invention comprises a portable infeed device that may be attached to a printer. Preferably, the infeed device is secured to the printer along its housing or other dedicated structure. On certain makes and models of the printer device, the infeed device may be clamped to a pair rails normally dedicated to hold a small internal paper roll. As web is unwound from the external roll apparatus, it forms a free loop between the external roll apparatus and the infeed device. The web enters the infeed device from the free loop into a narrow gap formed by a pair of parallel rods with adjustable edge guides that define the edges of the web path.

After the web passes the parallel rods it passes between a smooth metal shoe and a spring-loaded pressure pad. The spring-loaded pressure pad presses the web against the smooth metal shoe, which operates to create the primary drag force on the web. After passing the tensioning mechanism, the web, now under tension, is pulled around a curved smooth metal surface, extending from the shoe area, which imparts an additional amount of tension on the web. The curved smooth metal surface helps to maintain proper tension on the web as it passes through the rest of the printer.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF AN ILLUSTRATIVE EMBODIMENT

There is now described herein a substantially improved web infeed module that is adapted to accept external rolls of web material and accurately align and feed them into a printer or other web-handling device. In accordance with the present invention one of the substantial improvements herein relates to the use of an adjustable force pressure pad that applies essentially uniform pressure on the web from edge to edge to avoid steering the web as it is fed downstream through the infeed module and into the web-handling device. Another aspect of the present invention is that it uses a combination compression spring and dial assembly that allows the pressure on the web, and therefore the web tension, to be adjusted. This feature allows the present invention to accommodate a wide variety of web material and web thickness.

Also, in accordance with the present invention, there is a much-improved design in that there are preferably no rolling, or otherwise moving surfaces that contact the web as it is passes through the infeed module. Therefore, the web slides over all surfaces, eliminating the tendency for the web to be driven to the side, as would be the case if the web were traversing a misaligned roller.

Figure 1:
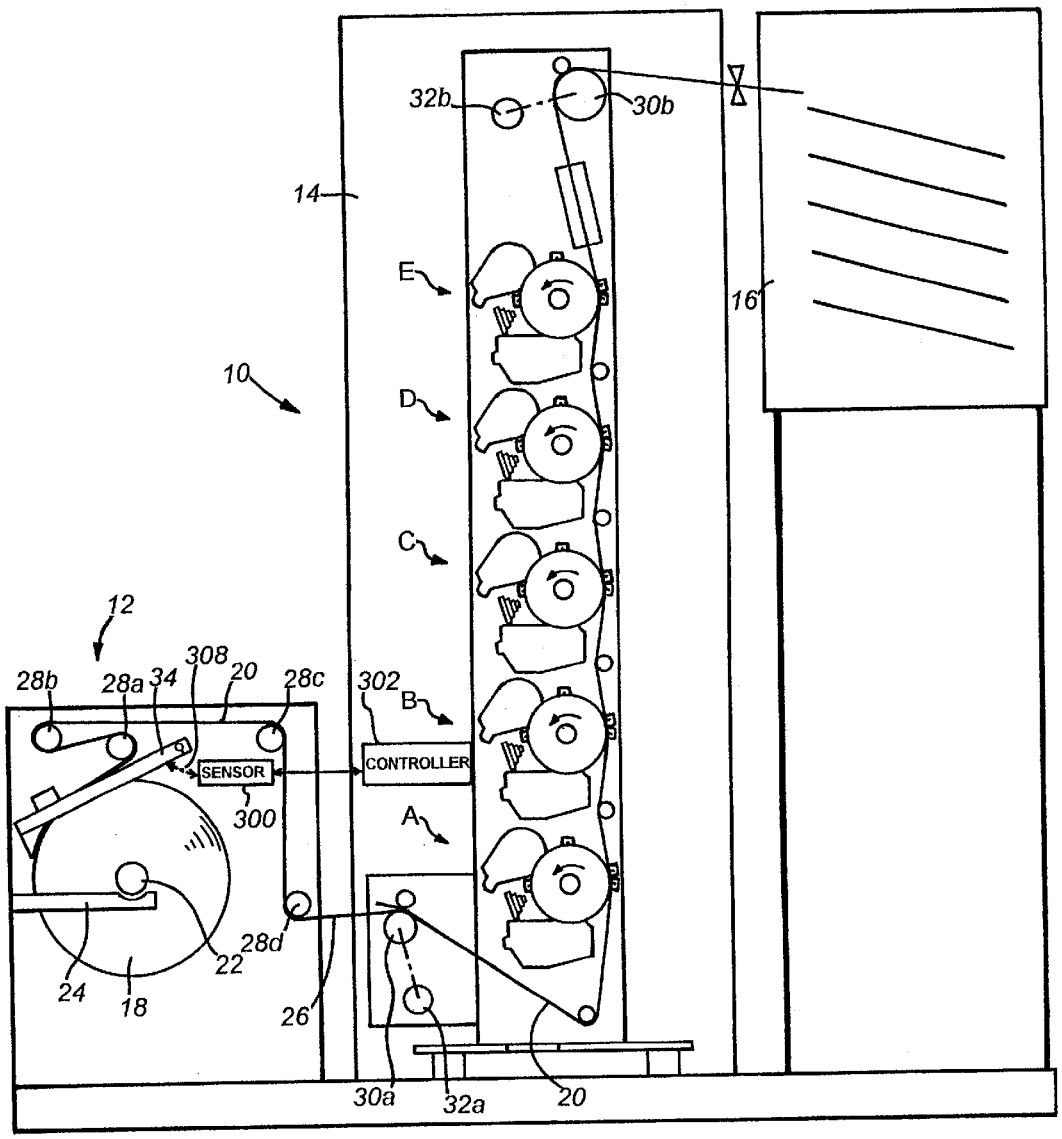
Fig. 1 (PRIOR ART)
FIG. 1 is a partial diagrammatic side view of an electrostatographic single-pass multiple station printer, showing the positional relationship of the various parts thereof, according to the prior art.

In an exemplary embodiment, the invention is utilized in a printing environment. Referring now more particularly to the drawings, wherein like numerals reference like or corresponding parts throughout the several views, there is shown in FIG. 1, a prior art printer device 10, such as disclosed in incorporated U.S. Pat. No. 4,499,093. FIG. 1 shows a representative single-pass printer device 10, having a plurality of printing stations A, B, C, D and E. Printer device 10 is shown having an attached web supply station 12, a tower-like printer housing 14 and a downstream stacker 16. The web supply station 12 is used for supplying rolls of web material to the printer and houses a supply roll 18 of web material 20. Supply roll 18 is wound around a core 22, which is supported in supply station 12 by a pair of rails 24. Also, within supply station 12, there may be included a number of paper conditioning operations, including heating and electrostatic discharge operations, which condition web material 20 prior to entry into printer device 10.

A leader section 26 of web 20 is guided through the paper conditioning operations in web supply station 12 via rollers 28*a*, 28*b* and 28*c* and into the tower-like printer housing 14, which houses printing stations A through E. The web is conveyed through the printer device 10 by motor driven drive rollers 30*a*, 30*b* one positioned between supply station 12 and the first printing station A and the second positioned between the last printing station E and the downstream stacker 16. A pair of controllable motors, 32*a*, 32*b*, drive the drive rollers 30*a*, 30*b*. One of the motors 32*a*, 32*b* is speed-controlled at such a rotational speed as to convey the web 20 at through the printer at a desired speed. Constant tension on web material 20, required to ensure that the web moves synchronously with the printing stations A through E, is generated by the application of a brake 34 acting upon supply roll 18.

Figure 2:
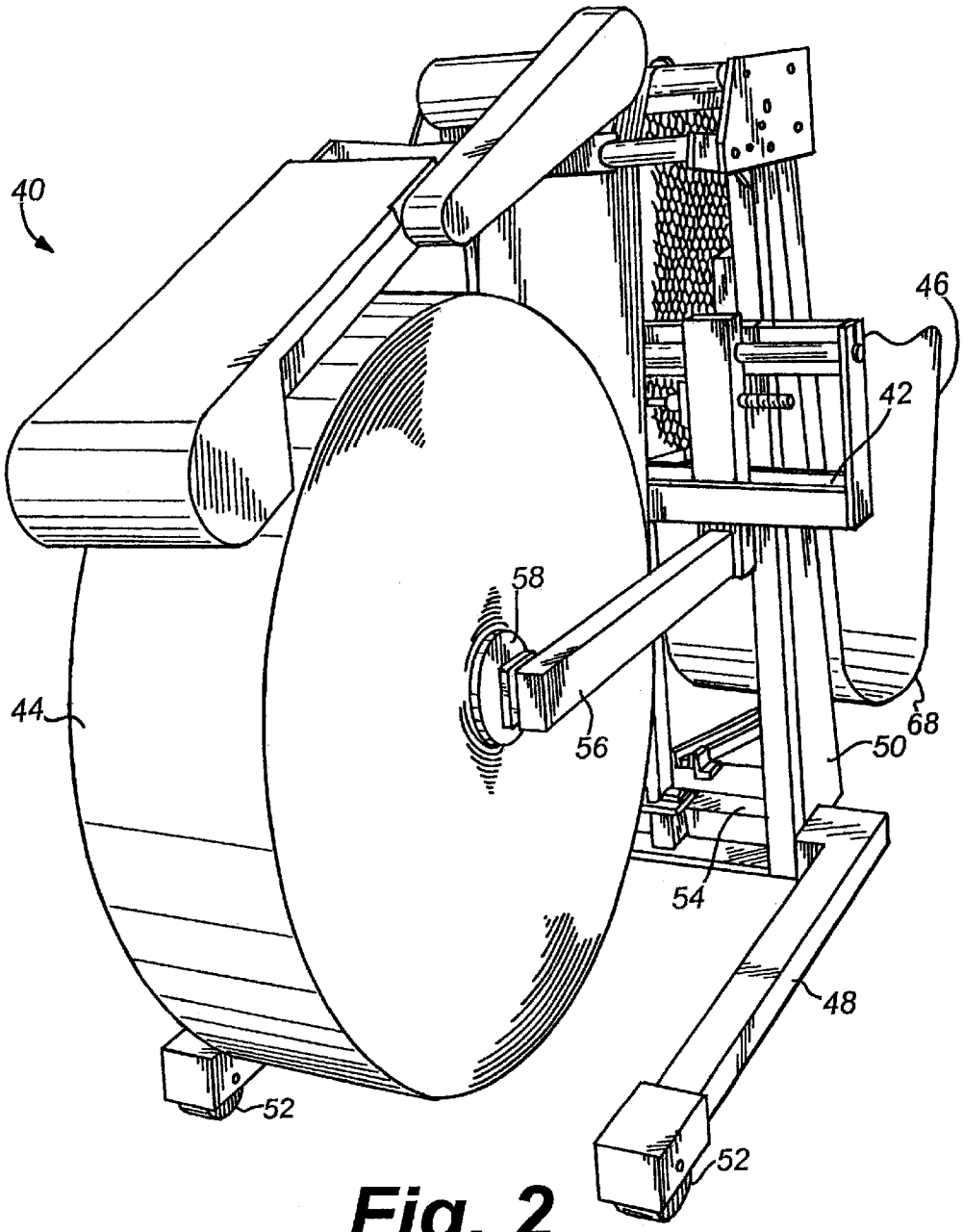
Fig. 2 (PRIOR ART)
FIG. 2 is a perspective view of an external roll feed machine according to the prior art.

On certain occasions, such as large print jobs, an alternate source of web, i.e. larger than supply roll 18, is desired. FIG. 2 depicts an exemplary high-volume, large-roll external feeding apparatus 40, such as described in incorporated U.S. Pat. No. 4,893,763, which includes a supply roll 44 of web material 42. This portable external feeding apparatus is comprised of a frame 46 having base legs 48 and upright members 50. The base legs 48 carry support wheels 52, which allow the feeding apparatus to be maneuvered more easily. Two of the wheels 52 are at the very ends of the base legs 48 and another pair of wheels 52 are disposed in a frame section 54 bridging the gap between upright members 50. The roll of web is supported in the external feeding apparatus 40 on a pair of support arms 56, each supporting at the respective free ends thereof a chuck 58.

Figure 3:
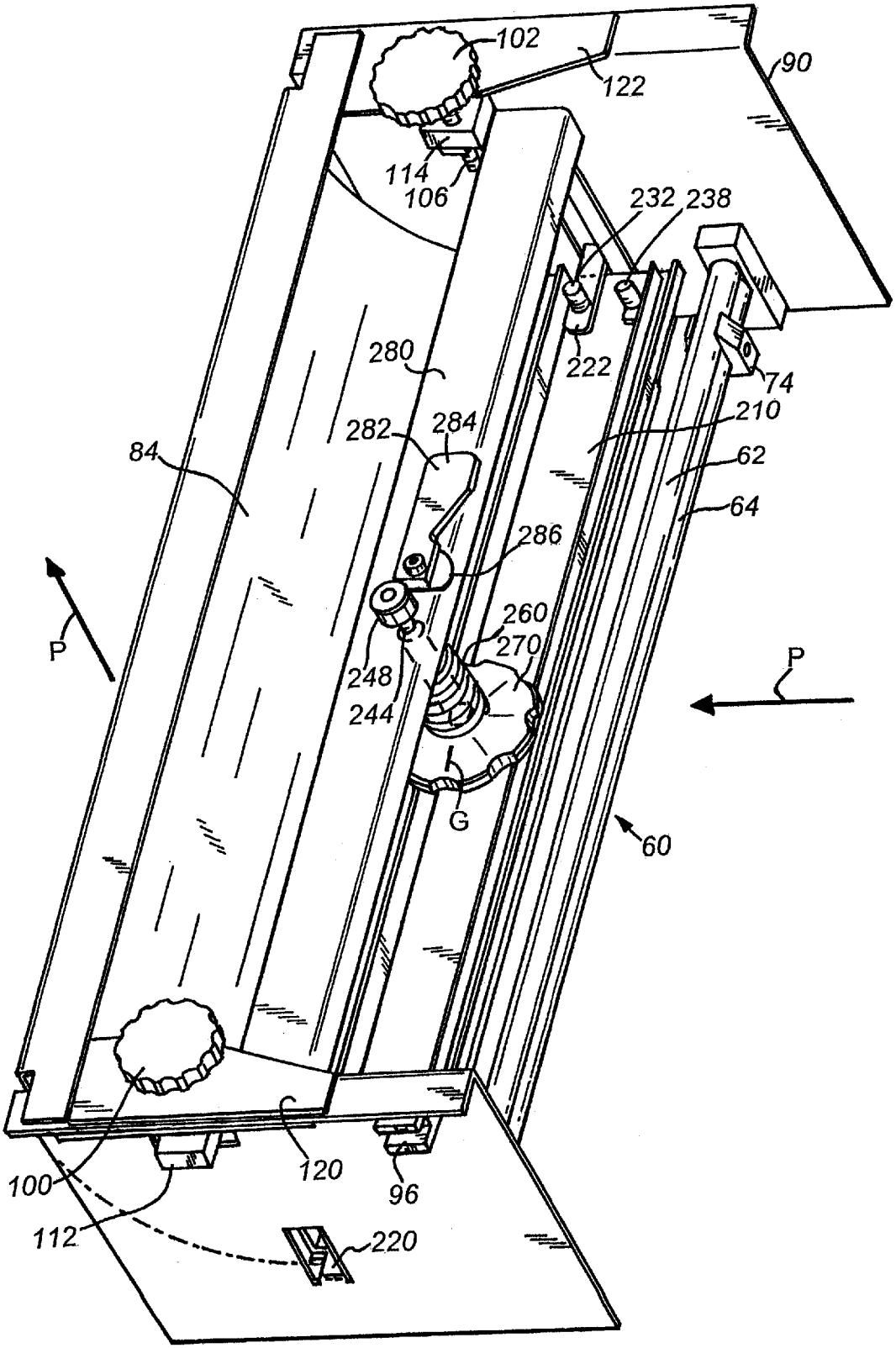
FIG. 3 is a perspective view of a web infeed module constructed in accordance with the principals of the present invention.
Figure 4:
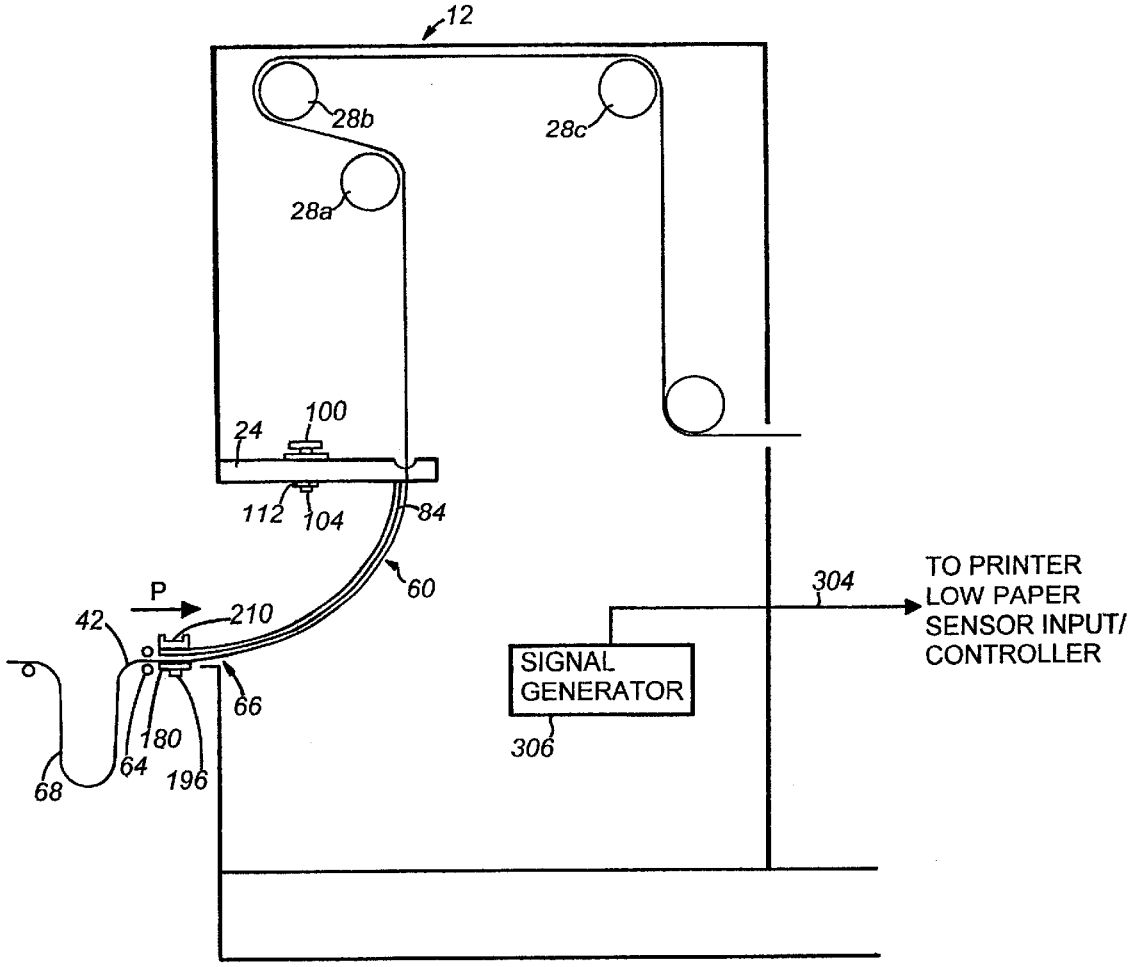
FIG. 4 is a partial diagrammatic view of the web infeed module of FIG. 3, attached to the printer of FIG. 1, with the printer's internal roll of web material replaced by the external roll feed machine of FIG. 2.

To properly supply web from the large-roll external feeding apparatus 40 to the printer device 10, an infeed module 60, approximately 1 to 2 feet in width and as generally depicted in FIGS. 3 and 4 is used. In the present embodiment the web supplied from supply roll 18 is replaced by supply roll 44. To accomplish this, supply roll 18 is removed from the supply station 12 and the infeed module 60 is removably attached to rails 24 in its place. A web inlet port 66 may need to be established in supply stations 12. As web 42 is unwound from supply roll 44, it forms a free loop of web material 68. Web 42 is fed through web inlet port 66, into infeed module 60 along path P, and into a set of upper and lower parallel rod guides 62, 64. As the web enters parallel rod guides 62, 64 it is under low tension, and therefore, it is free to adjust between the external feeding apparatus 40 and printer device 10. This feature of the present invention allows greater tolerance for misalignment between the external roll apparatus 40 and printer device 10.

Figure 5:
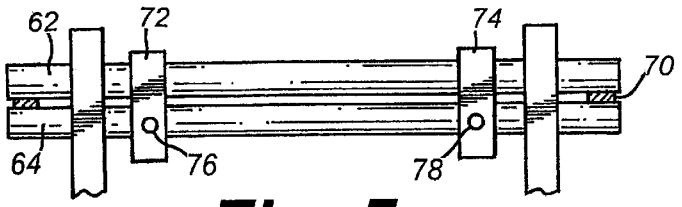
FIG. 5 is a partial enlarged view of a parallel rod guide mechanism of the web infeed module of FIG. 3.
Figure 6:
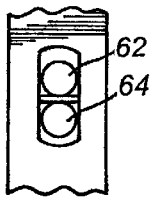
FIG. 6 is an end view of the parallel rod guides as shown in FIG. 5.

A more detailed view of the parallel rod guides 62, 64 is shown in FIGS. 5 & 6. In this embodiment, parallel rod guides 62, 64 are shown spaced apart from one another sufficiently such that web 42 may freely slide between the rods guides, yet remain in a substantially flat position. Parallel rod guides 62, 64 are spaced apart from one another by a spacing device 70. In one embodiment, spacing device 70 is about twice the thickness of web 42. Upper rod guide 62 is allowed to freely move vertically, held in place by its own weight, yet preferably, neither rod guide 62, 64 is free to rotate axially. A pair of edge guides 72, 74, adjustably attached to parallel rod guides 62, 64 by set screws 76, 78, or by other similar adjustable means, define the edges of the web path through the parallel rod guides 62, 64 that web 42 will follow. The parallel rod guides are typically polished steel rods with a diameter between approximately ¼ inch and ¾ inch in one embodiment.

Figure 7:
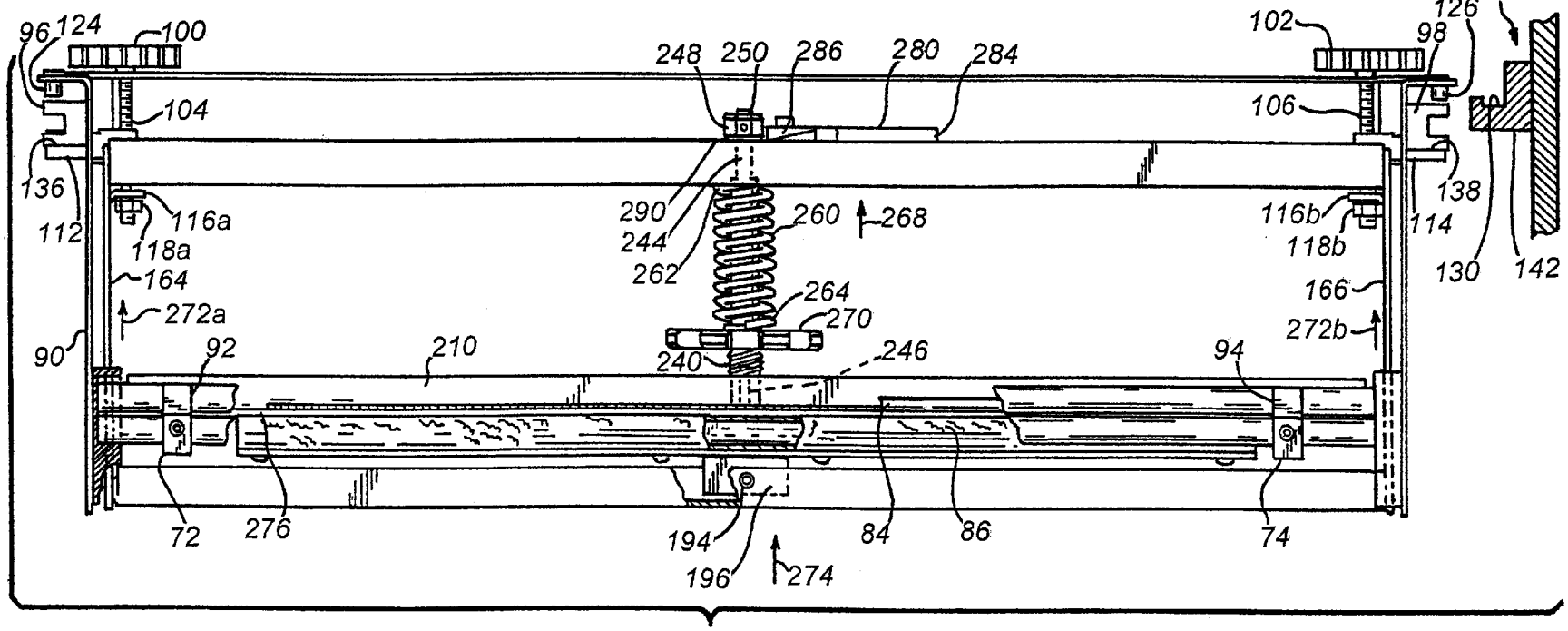
FIG. 7 is a partial cutaway side view of the web infeed module of FIG. 3.
Figure 8:
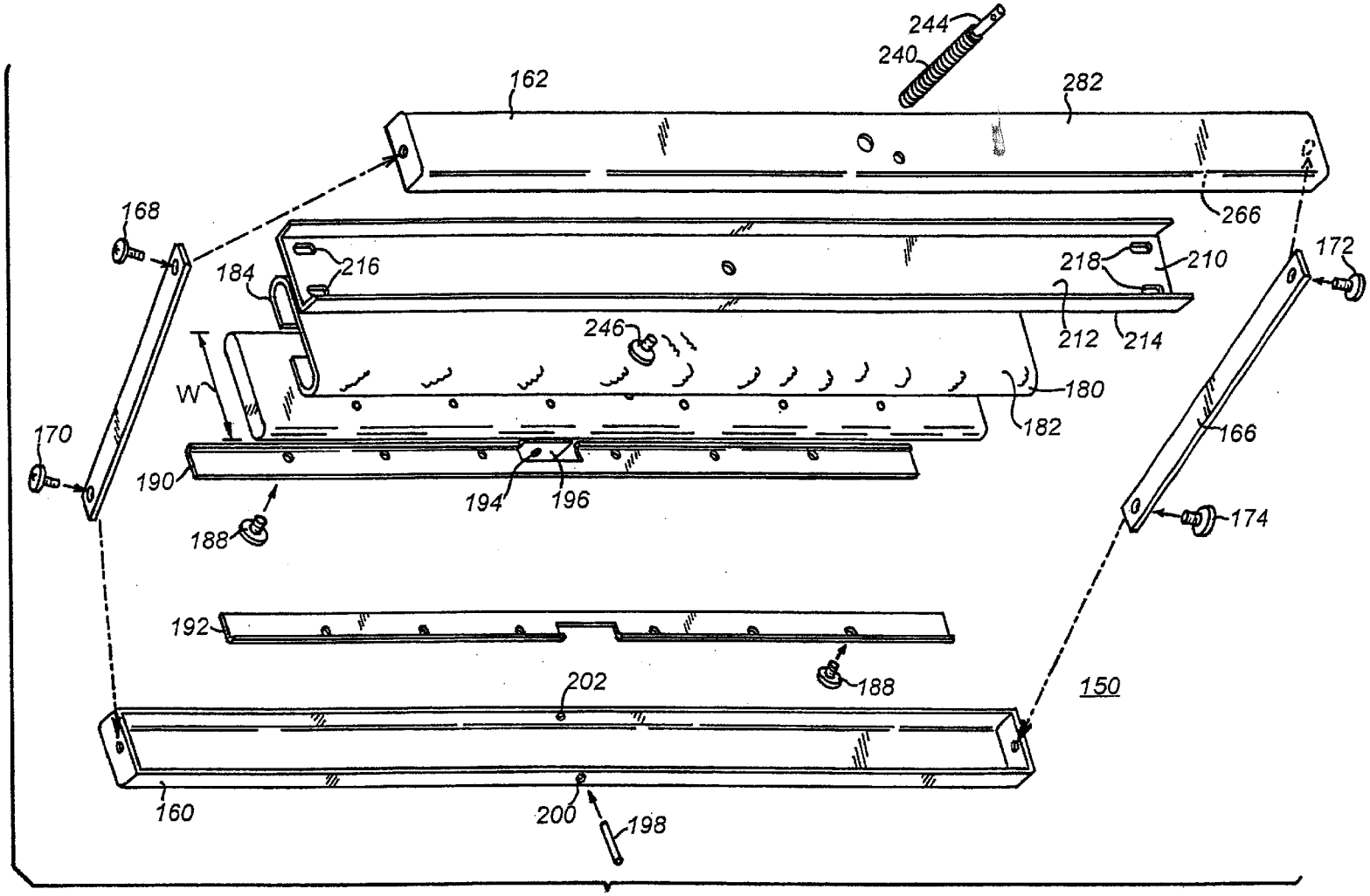
FIG. 8 is an exploded view of the tensioning mechanism of the web infeed module as shown in FIG. 3.

In addition to properly aligning web 42 between the external feeding apparatus 40 and printer device 10, another important function of infeed module 60 is to provide necessary tension on web 42 in order to maintain proper drag and guidance of the web as it travels downstream through supply station 12 and into printer device 10. Referring now to FIGS. 7–8, in order to achieve proper tension in web 42 after it passes between parallel rod guides 62, 64, the web is fed into a tensioning mechanism of infeed module 60. The tensioning mechanism of comprises a smooth metal shoe 84 and a spring-loaded pressure pad 86. Spring-loaded pressure pad 86 is adjusted to push against the metal shoe with a desired force. As web 42 is fed between metal shoe 84 and the spring-loaded pressure pad 86, tension and drag are created in the web. Preferably, pressure pad 86 applies uniform transverse pressure on web 42 between a pair of web edges 92, 94 to avoid steering the web 42 from side to side.

Preferably, there are no rolling surfaces in the infeed module 60, in this embodiment. The web 42 slides over all surfaces it contacts in the module. As a consequence, there is no tendency for the web to be gradually driven to the side, as would be the case if it were traversing a misaligned roller. In addition, the infeed module 60 does not contain any heavy elements, so it is relatively lightweight and can be easily handled by a single operator. A simple right angle infeed device could be added to the infeed module such that the web supply roll 18 could remain in place while the external feeding apparatus 40 is added or removed.

Infeed module 60 further comprises a frame 90, to which smooth metal shoe 84 is rigidly attached. A pair of stops 96, 98, rigidly attached to frame 90, help to align infeed module 60 with rails 24. In one embodiment, a pair of attachment mechanisms 100, 102 is used to secure frame 90 to rails 24. (see FIGS. 3–4) Attachment mechanisms 100, 102 include threaded members 104, 106, attached on one end to adjustment knobs 108, 110 and threadably attached on the other end to clamping mechanisms 112, 114. Threaded members 104, 106 are fed through top portions 120, 122 and are secured with bolts 116*a*, 116*b* to tabbed sections 118*a*, 118*b* of frame 90. To secure infeed module 60 to supply station 12, frame 90 is positioned onto rails 24, such that a pair of guide mechanisms 124, 126 rest in slots 128, 130 of rails 24. Turning adjustment knobs 108, 110 actuate the clamping mechanisms 112, 114. The adjustment knobs are individually turned until each of a pair of top surfaces 136, 138 of clamping mechanisms 112, 114 securely rest against a pair of bottom surfaces 140, 142 of rails 24. Other means for securing infeed module 60 to supply station 12 or printer device 10 may be used, including bolts, rivets or other clamping mechanisms.

Spring-loaded pressure pad 86 is part of a web-tensioning mechanism 150. Web-tensioning mechanism 150 includes a base 160. Base 160 is shown rigidly secured to a top piece 162 by a pair of side members 164, 166 and two pairs of screws 168, 170 and is 172, 174. Spring-loaded pressure pad 86 includes a base member 180, having an upper surface 182 and a lower surface 184. A length of drag material 186 is formed about the perimeter of base member 180 and is secured in place with a pair of strips 190, 192. Strips 190, 192 are secured to the lower surface 184 of base member 180 with a plurality of attachment screws 188. In one embodiment, drag material 186 comprises the same felt type material as used in the Xeikon printer devices for creating drag on the web for example a heavy felt having a thickness of ⅛–¼ inch. Preferably, base member 180 has a width W in the feed direction of between approximately 1 inch and 3 inches.

Web-tensioning mechanism 150 further includes a mounting block 196, rigidly attached to the lower surface 184 of base member 180, which is used to pivotally connect base member 180 to base 160. A pin 198 passes through a first hole 200 in base 160, through a hole 194 in mounting block 196 and finally through a second hole 202 in base 160. Pin 198 may be a rivet, screw or other mechanism that allows base member 180 to pivot with respect to base 160.

A channel member 210, having a top surface 212 and a bottom surface 214 is used to operatively attach web-tensioning mechanism 150 to infeed module 60 and to reinforce metal shoe 84 within frame 90. Channel member 210 is rigidly secured to both a top surface 216 of the metal shoe 84 and to base 90 of infeed module 60. A plurality of attachment cutouts 218 in channel member 210 allow for a variety of attachment means to be used to secure channel member 210 to metal shoe 84 and base 90. In one embodiment, a pair of tabbed sections 220, 222, having cutout openings 224, 226 (not shown), are formed in the sides of base 90 and folded over onto the top surface 212 of channel member 210. Channel member 210 is shown bolted to tabbed sections 220, 222 via a pair of nut and bolt fastening mechanisms 230, 232, which each pass through one of the cutouts 218 and through cutout openings 224, 226. (see FIG. 3). Channel member 210 is also shown bolted to metal shoe 84 via a pair of nut and bolt fastening mechanisms 236, 238, which each pass through metal shoe 84 and one of the cutouts 218.

A threaded member 240 is rigidly secured on a first internally threaded end 242 to channel member 210. A flush threaded fastener 246 mates with internally threaded end 242 and secures threaded member 240 to the top surface 212 of channel member 210. Threaded member 240, which has a threadless second end 244, protrudes from top surface 212 of channel member 210 and is slidably engaged on its second end 244 with top piece 162 of web-tensioning mechanism 150. In one embodiment, a nut 248 having a set crew 250 attaches to a portion of the threadless second end 244 protruding through top piece 162, which prevents the second end 244 from sliding back through top piece 162.

A compression spring 260, arranged about the circumference of threaded member 240, supplies the spring force that pressures spring-loaded pressure pad 86 against web 42. Compression spring 260 has a first end 262 and a second end 264. The first end 262 of compression spring 260 presses against a bottom surface 266 of top piece 162. The second end 264 of compression spring 260 rests against a graduated dial 270, which is threadably engaged with threaded member 240. Turning the graduated dial 270 in the appropriate direction loads spring 260. As compression spring 260 is loaded it presses against the bottom surface 266 of top piece 162. Top piece 162 transmits the force (arrow 268, FIG. 7) from compression spring 260 to side members 164, 166 (arrows 272*a*, 272*b*), which in turn transmit the force (arrow 274) to base 160, which in turn pivotally transmits the force to mounting block 196 and eventually to base member 180. When graduated dial 270 is sufficiently turned, the drag material 186 comes into contact with a lower surface 276 of metal shoe 84.

To properly tension web material 42, as it passes through the infeed module 60 in a downstream manner, it is threaded between base member 180 and metal shoe 84. A set of graduation marks G, on graduated dial 270 (see FIG. 3), allows an operator to adjust the drag experienced by web 42. These graduations can be used to indicate a variety of different parameters and dimensions related to tension in the web, including tension, drag, pressure, etc. Typical tension on the web is 0.5 to 2 pounds per lineal inch of web width and is controlled by the integrated pressure of the pressure pad 86, the coefficient of friction of the drag material 186, and that of the metal shoe 84.

Preferably, metal shoe 84 extends past the point of contact with pressure pad 86 in a substantially 90-degree arc. After web 42 passes pressure pad 86 it is pulled along the 90-degree arc of metal shoe 84, which amplifies the tension in web 42 a modest amount. To some extent, because heavier, thicker webs require more tension in the printer, the pad pressure is self-adjusting since thicker materials increase the spring force applied by spring-loaded pressure pad 86 on the smooth metal shoe 84. The shoe is positioned so that the outlet of web flows along a relatively normal unobstructed path into roller 28*a*. In this manner the original feed path of the small roll is largely maintained. Note the infeed module can be slid along the rails 24 to the appropriate position to optimize feed.

In practice, a full range of paper weights can be run with less than a full turn of the graduated dial 270. In addition, because pressure pad 86 is pivotally connected to base 160 by pin 198, the spring force transmitted to the pressure pad through the web tensioning mechanism 150 is directed away from the pivot point. This feature of the present invention helps to avoid any steering of web 42 as it passes downstream through infeed module 60.

A tension release lever 280, which is shown pivotally connected to an upper surface 282 of top piece 162, is used to temporarily release the tension applied by web tensioning mechanism 150 so that web 42 may be fed into the infeed module. Tension release lever 280 has a handle end 284 and a ramped end 286. As the tension release lever 280 is pivoted, ramped end 286 plies against a sloped surface 290 of nut 248. This action forces the entire web tensioning mechanism 150 down and away from metal shoe 84, which allows a gap of sufficient width through which web 42 may be fed.

An electronic interface to the printer may be achieved by intercepting the internal supply of web material's microswitches (or other equivalent sensors) 300, which are connected to the printer circuitry controller 302, with wiring 304 from the infeed module 60. Such original Low Paper sensors can be provided to the 'brake' arm (dashed arrow 308) and are activated based upon the swing of the arm. (see FIGS. 1 & 4). A magnetic switch/signal generator 306 attached to infeed module 60 enables, in the event that the external feed apparatus 40 is not ready, a "LOW PAPER" signal is triggered in the printer, causing the printer to stop, or preventing it from starting up. If infeed module 60 is removed from the printer device 10, thus opening the magnetic switch, the internal supply of web material's circuitry is restored to normal. Infeed module 60 is preferably adapted to include a plug or other switching device for rapid connect and disconnect of the electronic interface with the printer, such that the printer can be returned to its normal configuration at any time.

The foregoing has been a detailed description of a preferred embodiment of the invention. Various modifications and additions can be made without departing from the spirit and scope of the invention. For example, a variety of materials may be used for the pressure pad mechanism to achieve proper tension in the web. Hence, while felt material is used in this embodiment, other materials, preferably materials that conform to small non-uniformities in the web and can wear well can be used. In addition, a variety of circuitry configurations can be used. For example, the circuitry can be modified to support other printers or web-handling devices. Furthermore, the geometry of the infeed module can be varied widely to accommodate different feed paths. Likewise, the width of the device can be varied greatly to accommodate several widths of web material. Accordingly, this description is meant to be taken only by way of example and not to otherwise limit the scope of the invention.

What is claimed is:

1. A combination of a web source, a web-handling device and an apparatus for feeding web material from the web source into the web-handling device, aligning the web therewith, and tensioning the web as it is fed into the web-handling device, the combination comprising:

a frame of the apparatus having a first side and a second side;

a connector for attaching the frame to the web-handling device;

a pair of guide rods spaced apart in relative parallel position and attached at one end to the first side of the frame and attached at the other end to the second side of the frame;

at least one edge guide adjustably connected to the pair of guide rods for defining a web path; and a friction source on the apparatus, constructed and arranged to provide drag on the web between the web-handling device and the friction source, wherein the friction source comprises a smooth metal shoe connected to the frame and a spring-loaded pressure pad connected to the frame and arranged in relative parallel position with and constructed to pressurably engage the smooth metal shoe.

2. The combination as set forth in claim 1, wherein the web-handling device is adapted to receive web under tension from a small roll mounted in a fixed position with respect to the web-handling device.

3. The combination as set forth in claim 2, wherein the apparatus is positioned in the feed path normally occupied by a web leader section.

4. The combination as set forth in claim 1, wherein the web source is a high-volume, large roll support and feed apparatus.

5. The combination as set forth in claim 1, wherein the web-handling device is a printer.

6. The combination as set forth in claim 5, wherein the printer is a Xeikon printer.

7. The combination as set forth in claim 5, wherein the printer is a single pass duplex printer.

8. The combination as set forth in claim 1 further comprising a curved smooth surface connected to the frame over which the web passes prior to entering the web-handling device.

9. The combination as set forth in claim 8 wherein the curved smooth surface curves approximately 90 degrees from a leading edge to a trailing edge.

10. The combination as set forth in claim 1 wherein the apparatus is connected to a set of rails of the web-handling device.

11. The combination as set forth in claim 1 wherein an electronic interface is established between the apparatus, the web source and the web-handling device such that, in the event the web source is not ready, the web-handling device will not start up.

12. The combination as set forth in claim 11 wherein the electronic interface intercepts an existing printer paper supply sensor.

13. The combination as set forth in claim 12 further comprising a magnetic switch such that if the web source is not ready, a "LOW PAPER" signal is triggered.

14. The combination as set forth in claim 12 further comprising a magnetic switch such that if the apparatus is removed from the printer, the magnetic switch will be opened and the circuitry of the printer will be restored to a normal condition.

15. Apparatus for feeding web material from a web source into a web-handling device, aligning the web therewith, and tensioning the web as it is fed into the web-handling device the apparatus comprising:

a frame having a first side and a second side;

a connector for attaching the frame to the web-handling device;

a pair of guide rods spaced apart in relative parallel position and attached at one end to the first side of the frame and attached at the other end to the second side of the frame;

at least one edge guide adjustably connected to the pair of guide rods for defining a web path; and a friction source, constructed and arranged to provide drag on the web between the web-handling device and the friction source, wherein the friction source comprises a smooth metal shoe connected to the frame and a spring-loaded pressure pad connected to the frame and arranged in relative parallel position with and constructed to pressurably engage the smooth metal shoe.

16. The apparatus as set forth in claim 5 wherein the apparatus can accommodate papers from 60 to 250 gsm.

17. The apparatus as set forth in claim 15 wherein the web only contacts stationary parts.

18. The apparatus as set forth in claim 15 wherein the web can be turned at an angle between the web source and the apparatus.

19. The apparatus as set forth in claim 18 wherein the angle is substantially 90 degrees.

20. The apparatus as set forth in claim 15 wherein the smooth metal shoe and the spring-loaded pressure pad create a tension of between 0.5 and 2 pounds on the web.

21. The apparatus as set forth in claim 5 wherein the spring-loaded pressure pad further comprises a felt material commonly used in Xeikon printers for producing drag on the web.

22. The apparatus as set forth in claim 15, further comprising an adjustment knob connected to the spring-loaded pressure pad.

23. The apparatus as set forth in claim 22, wherein the knob further comprises graduation adjustments such that the amount of friction imparted on the web can be selected from a predetermined setting.

* * * * *